US010422328B2

(12) United States Patent
Hermansen et al.

(10) Patent No.: US 10,422,328 B2
(45) Date of Patent: Sep. 24, 2019

(54) BICYCLE PUMP

(71) Applicant: Crank Brothers, Inc., Laguna Beach, CA (US)

(72) Inventors: Frank Hermansen, Laguna Beach, CA (US); Carl Winefordner, Laguna Beach, CA (US)

(73) Assignee: Crank Brothers, Inc., Laguna Beach, CA (US)

( * ) Notice: Subject to any disclaimer, the term of this patent is extended or adjusted under 35 U.S.C. 154(b) by 0 days.

(21) Appl. No.: 15/961,586

(22) Filed: Apr. 24, 2018

(65) Prior Publication Data

US 2018/0238310 A1 Aug. 23, 2018

Related U.S. Application Data

(62) Division of application No. 14/968,766, filed on Dec. 14, 2015.

(51) Int. Cl.

| | |
|---|---|
| ***F04B 33/00*** | (2006.01) |
| ***F04B 39/12*** | (2006.01) |
| ***F04B 39/14*** | (2006.01) |
| ***F04B 53/22*** | (2006.01) |
| ***F04B 39/00*** | (2006.01) |

(Continued)

(52) U.S. Cl.

CPC ..... *F04B 33/005* (2013.01); *F04B 33/00* (2013.01); *F04B 39/121* (2013.01); *F04B 39/14* (2013.01); *F04B 53/22* (2013.01); *F04B 39/0005* (2013.01); *F04B 39/0016* (2013.01); *F04B 53/102* (2013.01); *F04B 53/121* (2013.01)

(58) Field of Classification Search

CPC ..... F04B 33/00; F04B 33/005; F04B 35/06; F04B 39/14; F04B 53/12; F04B 53/121; F04B 53/124–128; F04B 53/22; F16L 37/004

USPC ..... 417/234, 545, 553, 555.1; 92/58.1

See application file for complete search history.

(56) References Cited

U.S. PATENT DOCUMENTS

| | | | |
|---|---|---|---|
| 785,154 | A | 3/1905 | Cordeau |
| 1,447,963 | A | 3/1923 | Coleman |
| 1,484,549 | A | 2/1924 | Burnam |

(Continued)

FOREIGN PATENT DOCUMENTS

| | | |
|---|---|---|
| DE | 29813273 | 10/1998 |
| DE | 102009045772 | 4/2011 |
| DE | 202015104509 | 9/2015 |

OTHER PUBLICATIONS

International Search Report & Written Opinion, dated Mar. 10, 2017, 10 pages, PCT Patent Application No. PCT/IB2016/057386.

*Primary Examiner* — Alexander B Comley
(74) *Attorney, Agent, or Firm* — Haynes and Boone LLP

(57) ABSTRACT

A bicycle pump includes a pump body assembly, a handle assembly, a flexible hose assembly, and/or a magnet. The pump body assembly may include an outer tube, which defines an air chamber, and a head assembly with an air outlet opening. The handle assembly may slidably be associated with the body assembly, and include an inner tube and a piston, slidable inside the outer tube. The flexible hose assembly may be suitable to be stored inside the inner tube when the pump is not in use, and suitable to be connected to the air outlet opening during pumping. The magnet may connect the flexible hose assembly to the air outlet opening of the head assembly in a removable manner.

14 Claims, 12 Drawing Sheets

(51) Int. Cl.
*F04B 53/10* (2006.01)
*F04B 53/12* (2006.01)

(56) References Cited

U.S. PATENT DOCUMENTS 1,772,717 A 8/1930 Hasting
2,677,975 A 5/1954 Russell
3,181,895 A 5/1965 Cator
3,819,302 A * 6/1974 Ohashi ..... F04B 33/00 417/234
3,981,625 A 9/1976 Wickenberg
4,003,276 A 1/1977 Schmitt
4,569,275 A 2/1986 Brunet
4,712,592 A 12/1987 Brown
5,127,804 A 7/1992 Chappell
5,433,136 A 7/1995 Lung-Po
5,494,411 A 2/1996 Chuang
5,775,200 A 7/1998 Tsai
6,017,201 A 1/2000 Yang
6,116,873 A 9/2000 Wang
6,119,581 A 9/2000 Po
6,270,327 B1 8/2001 Wolz et al.
6,464,477 B1 10/2002 Wu
6,497,560 B2 12/2002 Carlson
6,652,242 B2 11/2003 Wu
6,817,060 B2 11/2004 Huang et al.
6,904,932 B1 * 6/2005 Haraughty ..... F16K 15/20 137/231
7,252,112 B1 * 8/2007 Imler ..... F16L 37/004 137/614.04
7,404,703 B2 7/2008 Wang
7,681,489 B2 3/2010 Wu
7,793,987 B1 9/2010 Busch et al.
8,136,844 B1 3/2012 Liu
9,011,801 B2 4/2015 Corso et al.
9,133,831 B2 9/2015 Wang
9,227,600 B2 1/2016 Chen
2008/0143098 A1 6/2008 Zimmermann et al.
2010/0028180 A1 2/2010 Gerritsen
2011/0000364 A1 1/2011 Holt
2011/0084474 A1 4/2011 Paden et al.
2011/0234035 A1 9/2011 Wittschier
2011/0252959 A1 10/2011 Huang
2011/0253228 A1 10/2011 Huang
2012/0031504 A1 * 2/2012 Wu ..... F04B 33/005 137/231
2012/0198826 A1 8/2012 Aubert et al.
2014/0318650 A1 10/2014 Wolff et al.
2015/0316042 A1 11/2015 Wang

* cited by examiner

BICYCLE PUMP

CROSS-REFERENCE TO RELATED APPLICATIONS

This application is a divisional of U.S. patent application Ser. No. 14/968,766 filed Dec. 14, 2015 and entitled "BICYCLE PUMP", the contents of which are incorporated herein by reference.

BACKGROUND

Technical Field

The present invention relates to a bicycle pump.

Related Art

Many types of bicycle tire pumps are known, for example hand pumps. Each type of pump has some advantages and some disadvantages. One type of portable bicycle tire hand pump has a flexible hose assembly that is stored inside the telescoping tubes and screwed into place when not in use. One advantage of this type of pump is that, when not in use, the pump is more compact, and therefore easier to carry; another advantage is that the flexible hose allows pump motion with less risk of damaging the tire valve, with respect to pumps in which there is a direct connection between the pump head and the tire valve itself.

To inflate a tire with this type of pump, the flexible hose assembly is first unscrewed from the handle assembly; then one end of the flexible hose is screwed into the pump body, and the other end is screwed onto the tire valve. When finished pumping, one end of the flexible hose must be unscrewed from the tire valve, the other end unscrewed from the pump body, and then the hose inserted back into the handle and screwed into the handle itself. Therefore, the entire process requires unthreading and threading six connections to inflate a tire and get the pump ready for storage. Additionally, for pumps of this type that will be carried on a bike frame, it is desirable for the handle to not inadvertently open; for this purpose, typically a rubber ring is provided that must be slid out of position for pumping, and back into position to frictionally hold the handle closed for storage.

In addition, portable bicycle tire hand pumps with flexible hoses that store inside the pump are designed to have the hose connected in-line with the pump: this requires that the hose bends about 90° for pumping in most situations, and that the pump be held very close to the tire being inflated. This results in a low comfort of use.

FIGS. 1-5 show a bicycle pump 300 according to the prior art. The bicycle pump 300 according to the prior art includes an outer tube 320, a handle assembly 370, a flexible hose assembly 330 and rubber end caps 340 and 350. The handle assembly 370 includes a handle 372 and an inner tube 374, ending with a piston 360. Hose assembly 330 is stored inside the handle assembly 370 when the pump 300 is not being used. Hose assembly 330 includes, at one end, a first flange 333 with a first thread 332 and a second thread 334, which are opposite with respect to the first flange 333. The second thread 334 connects the hose assembly 330 to the handle assembly 370 in the storage configuration. The first thread 332 connects the hose assembly 330 to the third thread 322 provided in the head portion of the pump 300, for pumping. At the other end of the hose assembly 330 a second flange 335 is provided, and a fourth thread 336 for an alternative connection to the third thread 322 in the head portion of the pump 300. More in detail, one end of the hose assembly 330 fits onto a shrader tire valve, and the other ends fits a presta tire valve.

In brief, from stow position, the user must first open rubber end caps 340, 350, unscrew the second thread 334 using the first flange 333, determine which type of tire valve will be used (presta or shrader), screw the correct hose assembly 330 end into the third thread 322, screw the other end of the hose assembly 330 onto the tire valve, and then inflate the tire. The user must repeat the same action in reverse order to put the hose assembly 330 back in the stow position. As shown in FIGS. 1-5 and described above, a typical prior art pump of this kind is unwieldy to use when starting from the storage configuration, and the effect of the pumping operation may not be satisfying.

SUMMARY

The technical aim of the present invention is therefore to improve the state of the art. Within such technical aim, various embodiments provide a bicycle pump which is more comfortable to use, a bicycle pump which is more comfortable to store when not in use, and a bicycle pump in which the handle assembly is prevented from inadvertently open in any situation.

The bicycle pump according to one embodiment of the invention comprises a pump body assembly including an outer tube, defining an air chamber, and a head assembly with an air outlet opening. The pump further includes a handle assembly, slidably associated with the body assembly, and including a piston, such piston comprising and inner tube slidable inside the outer tube. The pump further includes a flexible hose assembly suitable to be stored inside the inner tube when the pump is not in use, and suitable to be connected to the air outlet opening during pumping. The pump includes a magnetic connection means for connecting the flexible hose assembly to the air outlet opening of the head assembly in a removable manner.

According to another embodiment of the invention, the bicycle pump comprises a pump body assembly including an outer tube, defining an air chamber, and a head assembly with an air outlet opening. The pump further includes a handle assembly, slidably associated with the body assembly, and including an inner tube and a piston, slidable inside the outer tube. The pump further includes a flexible hose assembly suitable to be stored inside the inner tube when the pump is not in use, and suitable to be connected to the air outlet opening during pumping. The pump includes, in addition, a magnetic connection means for connecting the flexible hose assembly to the air outlet opening of the head assembly in a removable manner, wherein the air outlet opening is arranged substantially at 90° in relation to the axis of the piston, and wherein the head assembly comprises a rotatable sleeve suitable to selectively open or close the air outlet opening.

According to still another embodiment of the invention, the bicycle pump comprises a pump body assembly including an outer tube defining an air chamber, and a head assembly with an air outlet opening. The pump further includes a handle assembly, slidably associated with the body assembly, and including an inner tube and a piston, slidable inside the outer tube. The pump further includes a flexible hose assembly, suitable to be stored inside the inner tube when the pump is not in use, and suitable to be connected to the air outlet opening during pumping. The pump includes a magnetic connection means for connecting the flexible hose assembly to the air outlet opening of the head assembly in a removable manner. The handle assembly includes a handle which can pivot from a closed position, in which the handle assembly is locked to the body assembly in a storage configuration, to an open position in which the handle assembly is freely movable with respect to the body assembly.

BRIEF DESCRIPTION OF THE FIGURES

These and other advantages will be better understood by one skilled in the art from the following description that follows and from the attached drawings, given as non-limiting examples, in which.

DETAILED DESCRIPTION

Figure 1:
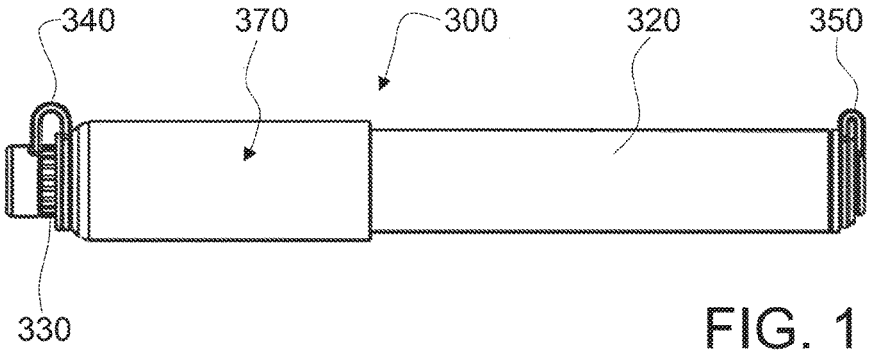
FIG. 1 (PRIOR ART)
FIG. 1 is a side view of a bicycle tire pump according to the prior art, with a flexible hose assembly contained inside.
Figure 2:
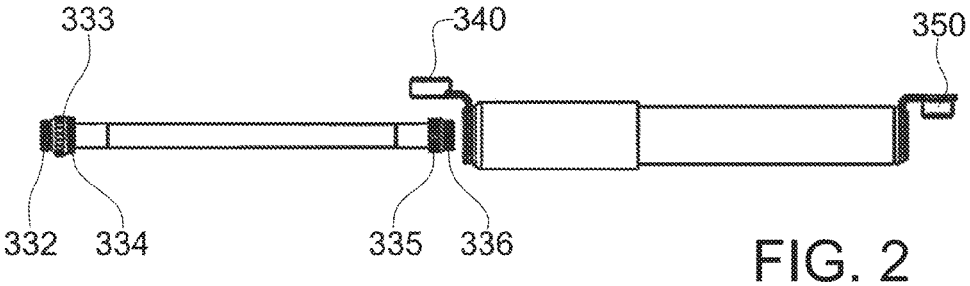
FIG. 2 (PRIOR ART)
FIG. 2 is a side view of the prior art pump of FIG. 1 with the flexible hose assembly removed.
Figure 3:
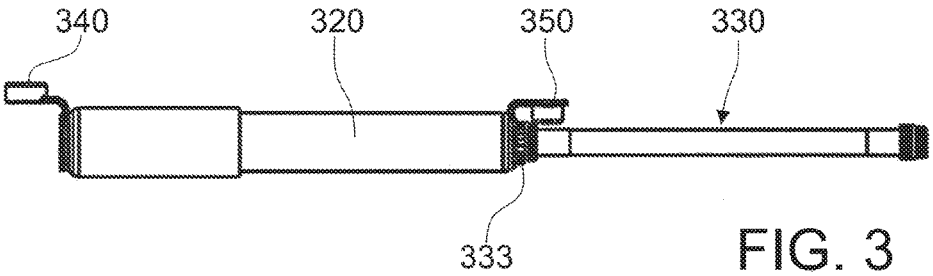
FIG. 3 (PRIOR ART)
FIG. 3 is a side view of the prior pump of FIG. 1 with the flexible hose assembly installed and ready for pumping.
Figure 4:
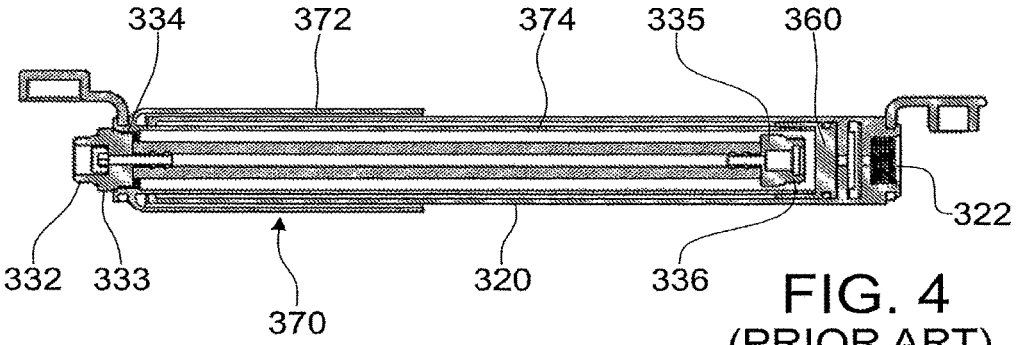
FIG. 4 (PRIOR ART)
FIG. 4 is a section view of the prior pump of FIG. 1 with the end caps open.
Figure 5:
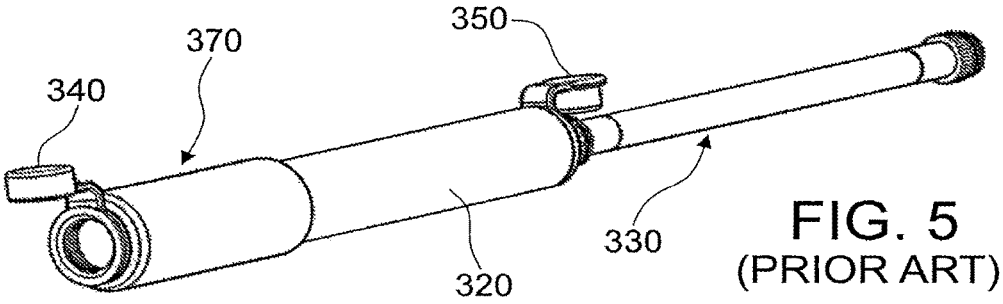
FIG. 5 (PRIOR ART)
FIG. 5 is a perspective view of the prior art pump of FIG. 1 with the flexible hose assembly installed and ready for pumping.
Figure 6:
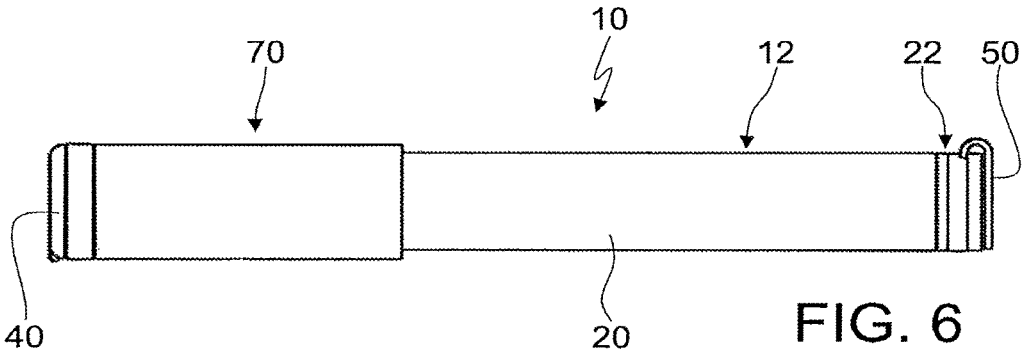
FIG. 6 is a side view of a bicycle pump according to one embodiment of the present invention.
Figure 7:
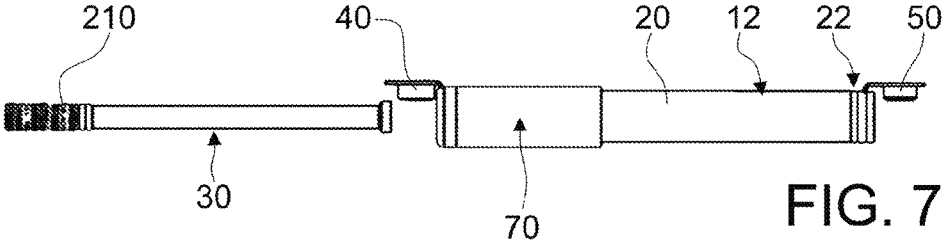
FIG. 7 is a side view of the bicycle pump of FIG. 6 according to one embodiment of the invention with the flexible hose assembly removed.
Figure 8:
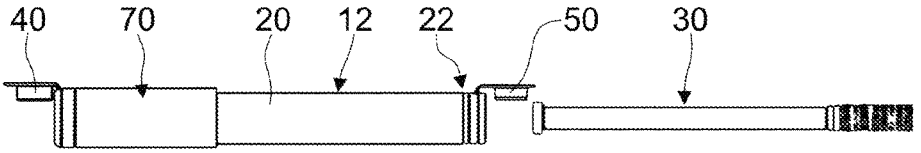
FIG. 8 is a side view of the bicycle pump of FIG. 6 according to one embodiment of the invention with the flexible hose assembly almost installed for pumping.
Figure 9:
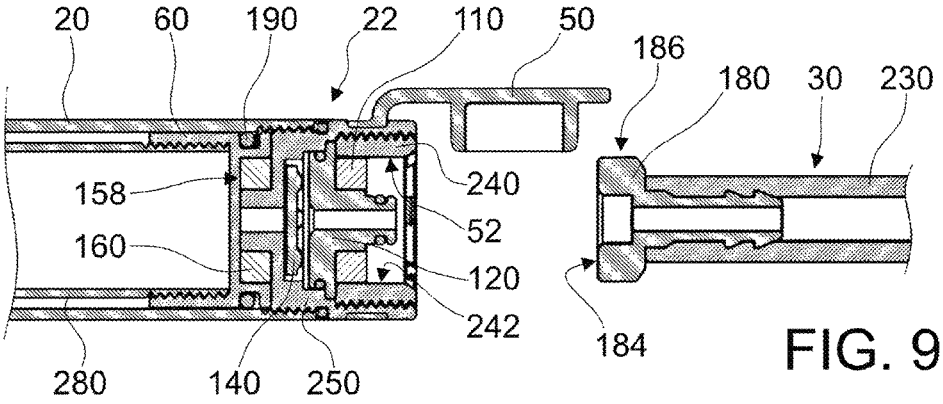
FIG. 9 is a close up sectional view of the pump in the situation shown in FIG. 8 according to one embodiment of the invention.
Figure 10:
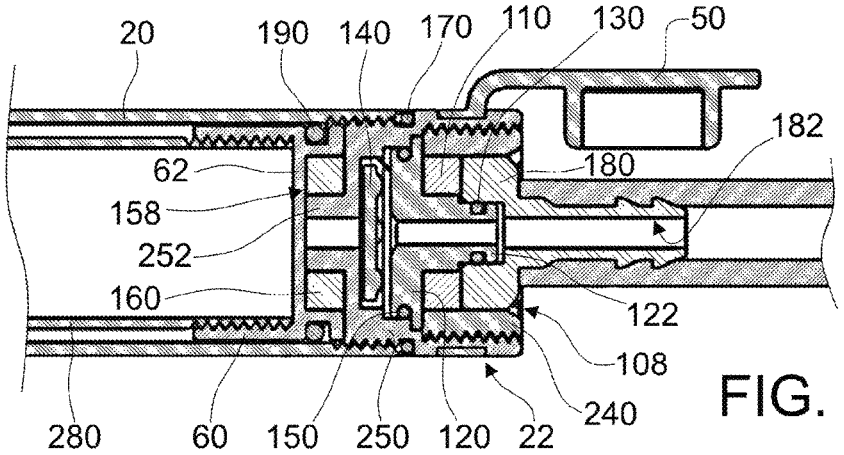
FIG. 10 is a close up sectional view of the pump of FIG. 6 according to one embodiment of the invention with the flexible hose assembly magnetically connected to the pump.
Figure 11:
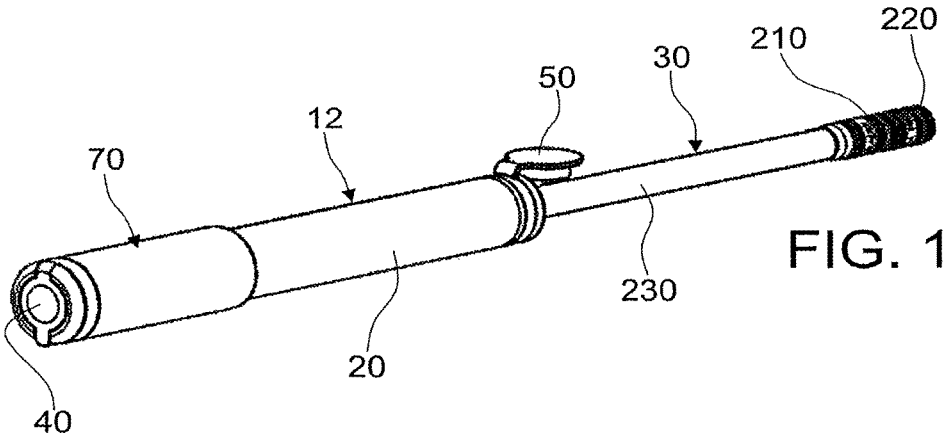
FIG. 11 is a perspective view of the pump of FIG. 6 according to one embodiment of the invention with the flexible hose assembly installed and ready for pumping.

With reference to the schematic representation of FIGS. 6-17, a bicycle pump according to one embodiment of the invention is wholly indicated with 10. Note that various elements described herein may be omitted or combined in different embodiments.

The bicycle pump 10 comprises a body assembly 12. The body assembly 12 includes an outer tube 20, and a head assembly 22. The outer tube 20 defines an air chamber 24, suitable for drawing air volumes from the outside and to transfer them into the tire through the tire valve, in a conventional manner.

The pump 10 further comprises a handle assembly 70. The handle assembly 70 is slidably associated with the body assembly 12. The handle assembly 70 includes a handle 260, a ring 270, an inner tube 280 and a piston 60; the piston 60 comprises an O-ring 190 for slidably sealing against outer tube 20's inner surface during pumping. Piston 60 is designed to allow O-ring 190 to unseal during the pull stroke, allowing air to refill the air chamber 24.

Figure 12:
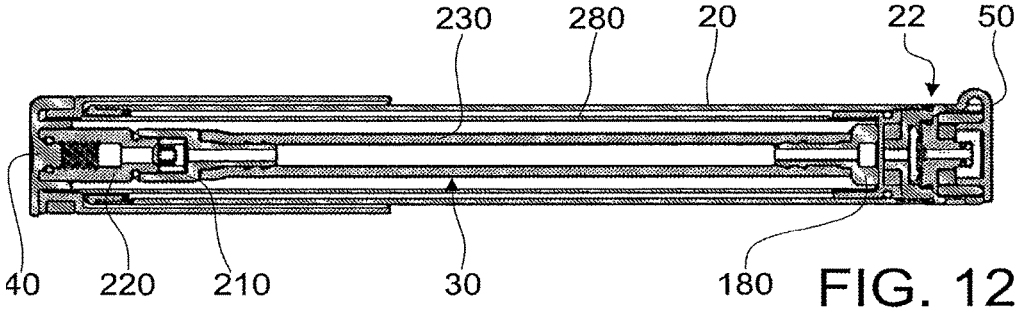
FIG. 12 is a sectional view of the pump of FIG. 6 according to one embodiment of the invention.
Figure 13:
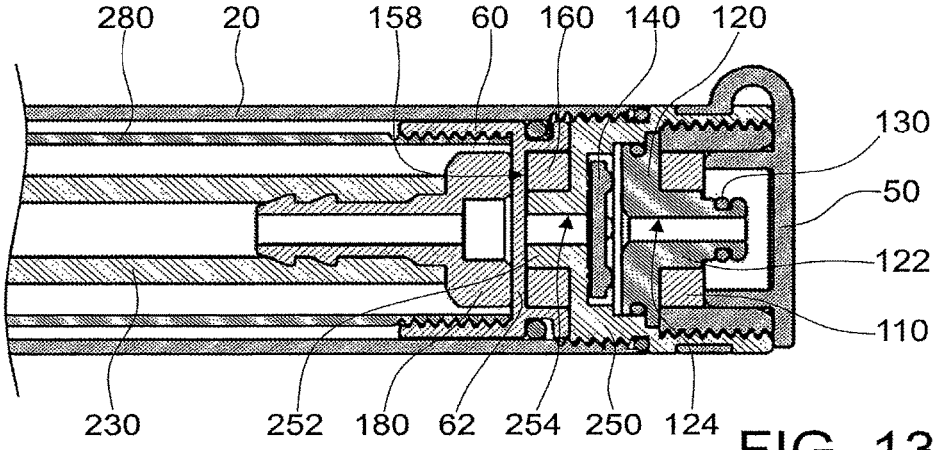
FIG. 13 is a close up sectional view of the pump of FIG. 12, wherein the flexible hose assembly magnetically holds the piston closed.
Figure 14:
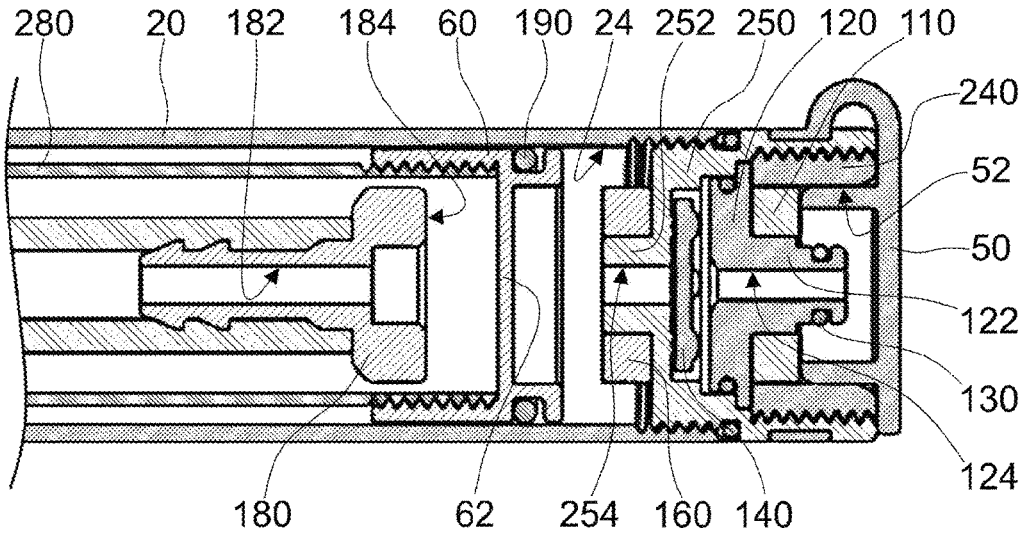
FIG. 14 is a close up sectional view of the pump shown in FIG. 12, with the flexible hose assembly pulled partially out of the pump.
Figure 15:
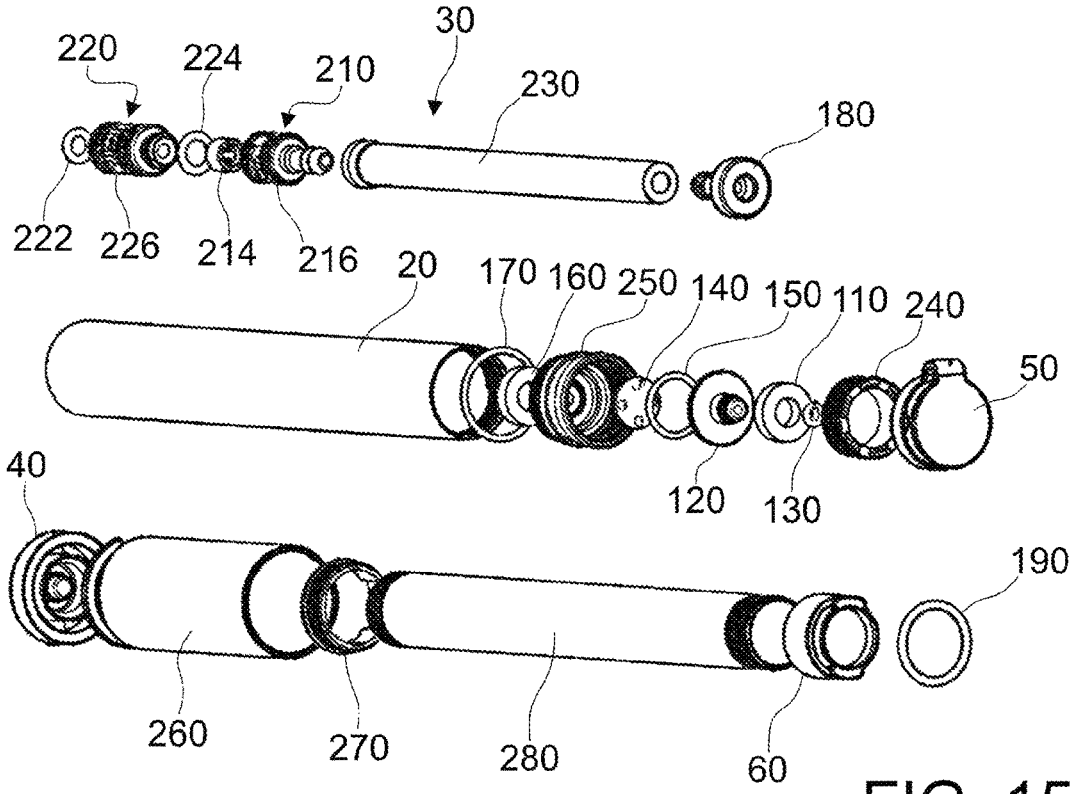
FIG. 15 is an exploded view of the pump of FIG. 6 according to one embodiment of the invention.
Figure 16:
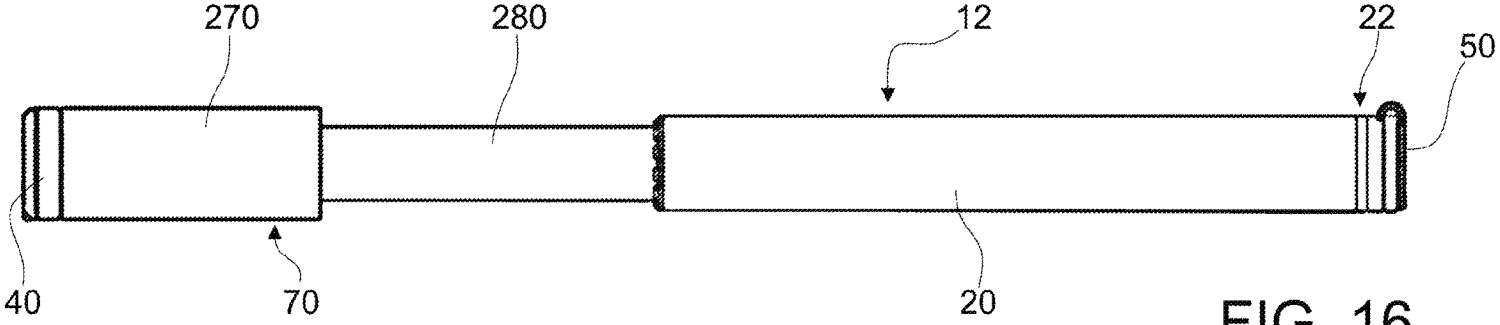
FIG. 16 is a side view of the pump of FIG. 6 fully pulled open.
Figure 17:
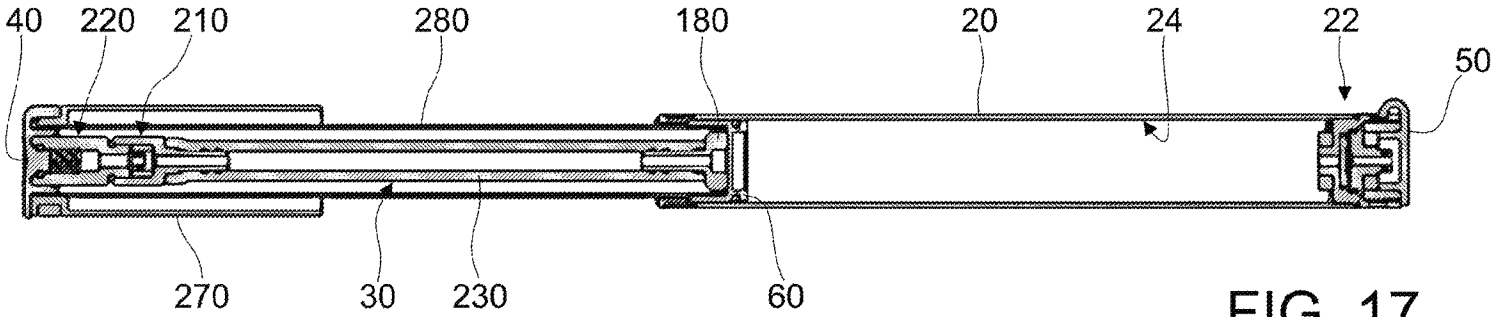
FIG. 17 is a sectional view of the pump shown in FIG. 16.
Figure 18:
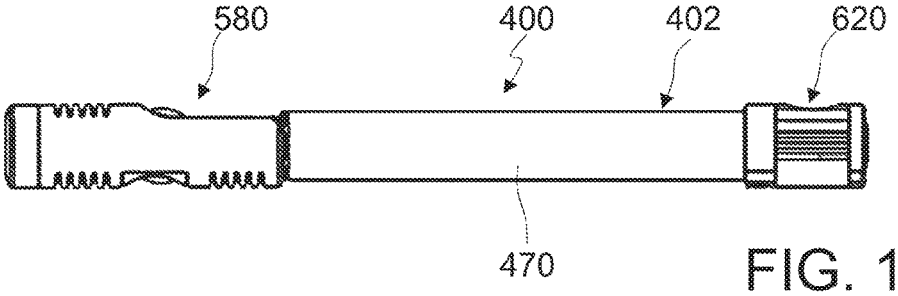
FIG. 18 is a side view of a bicycle pump according to an alternative embodiment of the invention.
Figure 19:
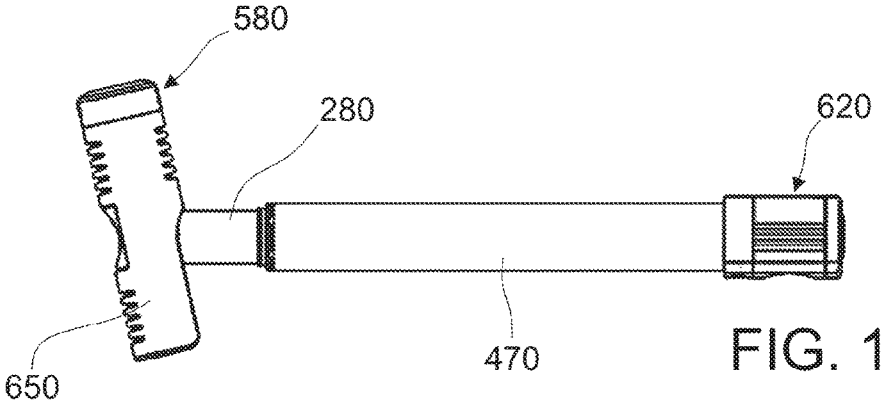
FIG. 19 is a side view of the pump shown in FIG. 18, with the handle pivoted into the open position and with the flexible hose assembly stored inside.

The pump 10 further includes a flexible hose assembly 30. When the pump 10 is not in use, the flexible hose assembly 30 is stored inside the handle assembly 70. More in detail, as shown in FIG. 12, the flexible hose assembly 30 is stored inside the inner tube 280. For this purpose, the handle assembly 70 includes a first end cap 40. The first end cap 40 allows easy and quick access to the inner cavity of the inner tube 280. The first end cap 40 is made, for example, from rubber.

The head assembly 22 of the body assembly 12 is connectable to the flexible hose assembly 30 during pumping. The head assembly 22 comprises a housing 250. The housing 250 includes an axial air passage 254, communicating with the air chamber 24. The housing 250 is connected to an end of the outer tube 20; an O-ring 170 is tightened between the housing 250 and the end of the outer tube 20. The housing 250 comprises a tubular extension 252, which is arranged axially and opposite to the axial protrusion 122 (i.e. facing the opening 52). The head assembly 22 further includes a thread ring 240 connected to the housing 250. A fitting 120 is tightened between the housing 250 and the thread ring 240; an O-ring 150 seals the fitting 120 to the housing 250. The fitting 120 includes an axial protrusion 122, provided with an O-ring 130, and an axial air channel 124. A one way valve 140 is interposed between the housing 250 and the fitting 120. The one way valve 140 is disc shaped. During pumping, piston 60 of handle assembly 70 pushes air through the housing 250; the air flows around valve disc 140 and through fitting 120, and from the latter into flexible hose assembly 30 and through the tire valve into the tire.

The head assembly 22 includes a second end cap 50. The second end cap 50 is made, for example, from rubber. The second end cap 50 selectively opens and closes an air outlet opening 52, provided in the head assembly 22, for accessing the fitting 120; when the second end cap 50 is open, the flexible hose assembly 30 can be connected to the fitting 120 through the opening 52. The second end cap 50 presses inside of thread ring 240 to keep contamination out of the pump when stored.

According to some embodiments of the invention, the pump 10 includes a magnetic connection means 108 for connecting the flexible hose assembly 30 to the air outlet opening 52 (i.e. to the fitting 120) of the head assembly 22 in a removable manner. The magnetic connection means 108 includes a first magnet 110. The first magnet 110 is housed in the head assembly 22. The first magnet 110 is ring shaped, or substantially ring shaped. The first magnet 110 is press fit and/or bonded to the fitting 120, and it faces the opening 52. In detail, the first magnet 110 is press fit and/or bonded to the axial protrusion 122 of the fitting 120.

According to some embodiments of the invention, the pump 10 includes magnetic retention means 158 of the handle assembly 70 inside the body assembly 12 when the pump is not in use. The magnetic retention means 158 include a second magnet 160. The second magnet 160 is ring shaped, or substantially ring shaped. The second magnet 160 is press fit and/or bonded to the housing 250, and it faces the air chamber 24. More in detail, the second magnet 160 is press fit and/or bonded to the tubular extension 252 protruding from the housing 250 and facing the air chamber 24. According to one embodiment, the second magnet 160 holds the handle assembly 70 closed when the flexible hose assembly 30 is stored inside the handle assembly 70 itself, as better disclosed hereafter.

The flexible hose assembly 30 includes a flexible hose 230. The flexible hose assembly 30 further includes a fitting 180, connected to a first end of the flexible hose 230. The fitting 180 is made from a magnetically attracted metal (for example steel). The fitting 180 includes a passing orifice 182. The flexible hose assembly 30 includes a shrader valve adapter assembly 210, connected to the second end of the flexible hose 230. The shrader valve adapter assembly 210 includes a housing 216 and a pin valve 214. The flexible hose assembly 30 further includes a presta valve adapter assembly 220, which is screwed to the shrader valve adapter assembly 210. The presta valve adapter assembly 220 includes a housing 226 and O-rings 222, 224.

Referring now to FIGS. 6 and 12-14, when the pump 10 is not in use, the handle assembly 70 is magnetically held closed during storage. More in detail, when the flexible hose assembly 30 is positioned inside the inner tube 280 of the closed handle assembly 70, the fitting 180 (which is metallic) is magnetically attracted to the second magnet 160, through the wall 62 of the piston 60. Wall 62 is thin enough to allow a sufficient magnetic attraction to hold the handle assembly 70 closed for storage. In addition, as a consequence, the magnetic attraction between the second magnet 160 and the fitting 180 secures the flexible hose assembly 30 in the stored position inside the inner tube 280. Therefore, a strong connection between the first end cap 40—which for example is made of rubber—and the handle assembly 70 is not required. Any risk of the handle assembly 70 inadvertently sliding out of the body assembly 12 is therefore prevented with a simple and practical solution.

As the handle assembly 70 is intentionally pulled partly open, the distance between the first magnet 160 and the fitting 180 becomes big enough to easily remove the flexible hose assembly 30 from the handle assembly 70. Now the handle assembly 70 is freely movable relative to the body assembly 12. In addition, according to one embodiment of the invention, when the flexible hose assembly 30 is connected to the head assembly 22 during pumping, there is no magnetic attraction holding the handle assembly 70 closed: therefore, pumping is made easier.

Referring now to FIGS. 8-11, to connect the flexible hose assembly 30 to the head assembly 22 of the pump 10, fitting 180 is placed nearby the opening 52 of the head assembly 22. Face 184 of the fitting 180 is therefore magnetically attracted by the first magnet 110; as face 184 firmly sticks to the first magnet 110, the O-ring 130 of the fitting 120 seals against the orifice 182 of the fitting 180. At the same time, the lateral surface 186 of the fitting 180 contacts the inner surface 242 of the thread ring 240, to create a more stable connection between the flexible hose assembly 30 and the pump 10.

After the pumping is performed, the fitting 180 is disconnected from the first magnet 110, and the flexible hose assembly 30 is stored back into the inner tube 280 of the handle assembly 70. The fitting 180 is therefore again magnetically attracted to the second magnet 160, and the handle assembly 70 is safely held in storage position. Such storage position is therefore safer and more practical to achieve when compared to the solutions according to the prior art.

Another embodiment of a bicycle pump 400 according to the invention is shown in FIGS. 18-32. The pump 400 includes a body assembly 402. The body assembly 402 includes an outer tube 470, and a head assembly 620. The outer tube 470 defines an air chamber 472 inside. The pump 400 further comprises a handle assembly 580, slidably associated with the body assembly 402. The pump 400 includes a flexible hose assembly 610.

Figure 20:
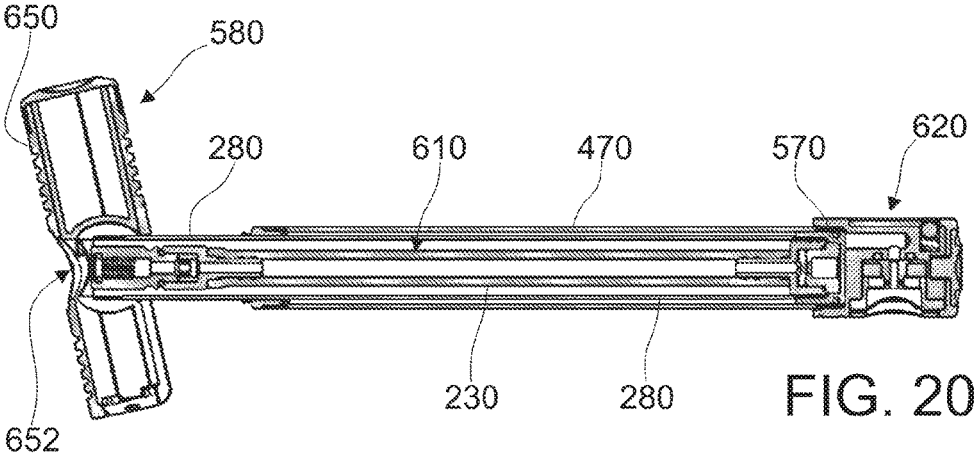
FIG. 20 is a sectional view of the pump shown in FIG. 19.
Figure 21:
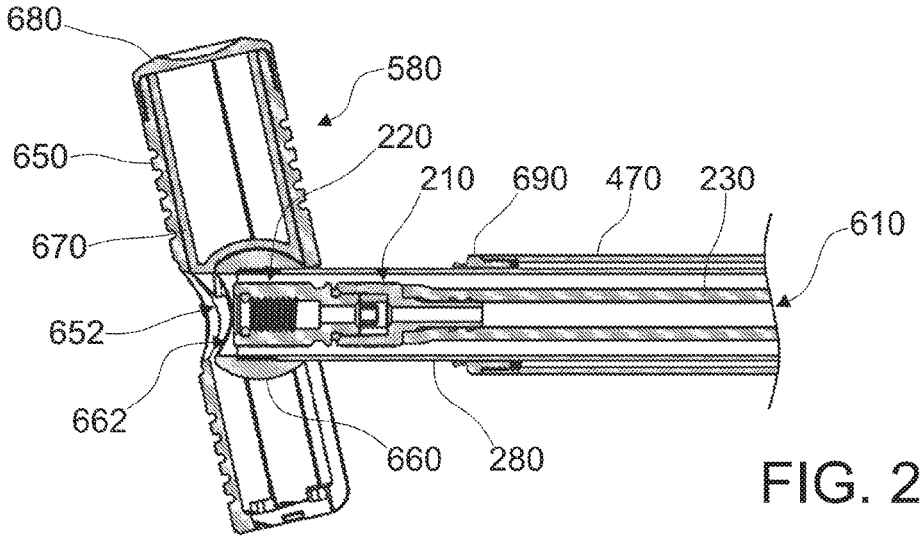
FIG. 21 is a close up of FIG. 20.

When the pump 400 is not in use, the flexible hose assembly 610 is stored inside the handle assembly 580. More in detail, as shown in FIG. 20, the flexible hose assembly 610 is stored inside the inner tube 280 of the body assembly 402. According to one embodiment of the invention, and as better disclosed hereafter, the handle assembly 580 is suitable to pivot from a closed position (during storage) to an open position to provide access to the flexible hose assembly 610 in the inner tube 280, and for improved ergonomics during pumping.

The handle assembly 580 includes a piston 570 and an inner tube 280; the piston 570 comprises an O-ring 190 for slidably sealing against outer tube 470's inner surface during pumping. The outer tube 470 of the body assembly 402 includes a thread ring 690 connected to one end thereof, which contacts the inner tube 280 of the handle assembly 580. Piston 570 is designed to allow O-ring 190 to unseal during the pull stroke, allowing air to refill the air chamber 472.

The handle assembly 580 further comprises a handle 650 and a handle insert 670, fitted inside the handle 650; an end cap 680 secures handle insert 670 inside of handle 650. The handle 650 includes a first opening 652. The first opening 652 is arranged laterally on the handle 650.

The handle assembly 580 includes an inner tube cap 660, screwed onto the inner tube 280. The inner tube cap 660 comprises a second opening 662. The inner tube cap 660 further includes two round bosses 664, which are trapped between a first surface 656 of the handle 650 and an opposite second surface 672 of the handle insert 670: thanks to this solution, the handle 650 can pivot around the bosses 664 from the closed storage position (FIGS. 18, 23, and 24) to the open pumping position (FIGS. 19-21 and 25), and vice versa.

Figure 22:
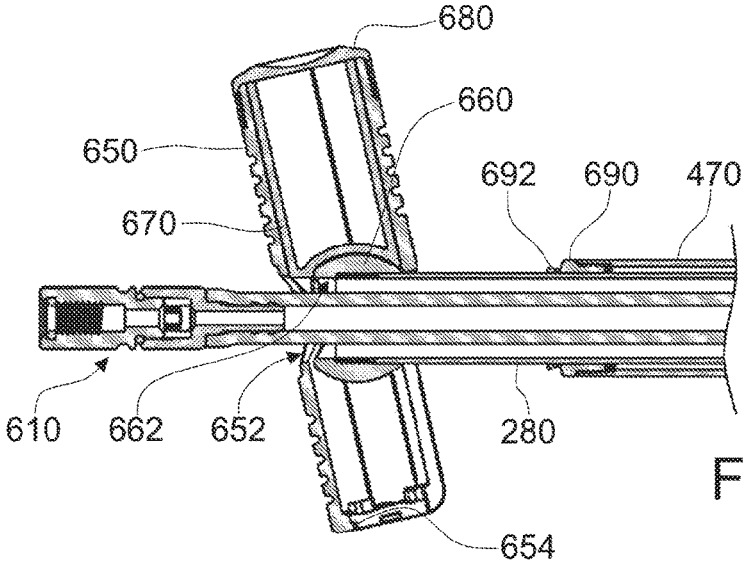
FIG. 22 is a close up sectional view of the pump in the configuration shown in FIG. 19, with the flexible hose assembly partially removed.
Figure 23:
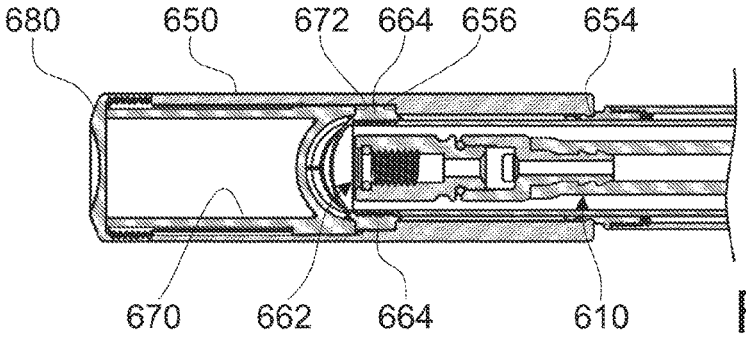
FIG. 23 is a close up sectional view of the pump in the configuration shown in FIG. 18.
Figure 24:
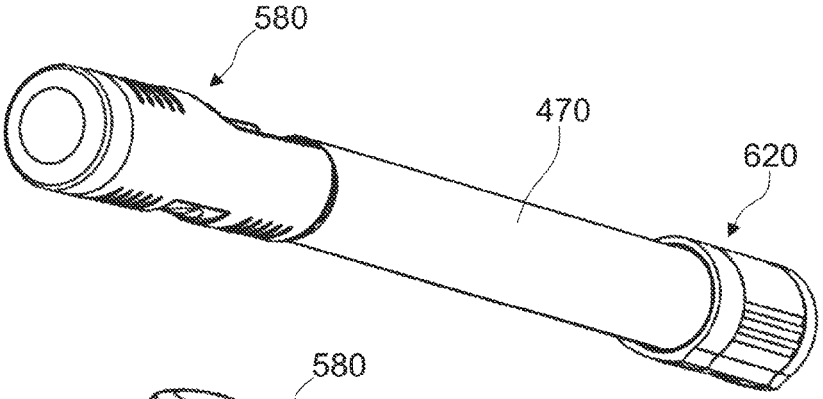
FIG. 24 is a perspective view of the pump shown in FIG. 18.
Figure 25:
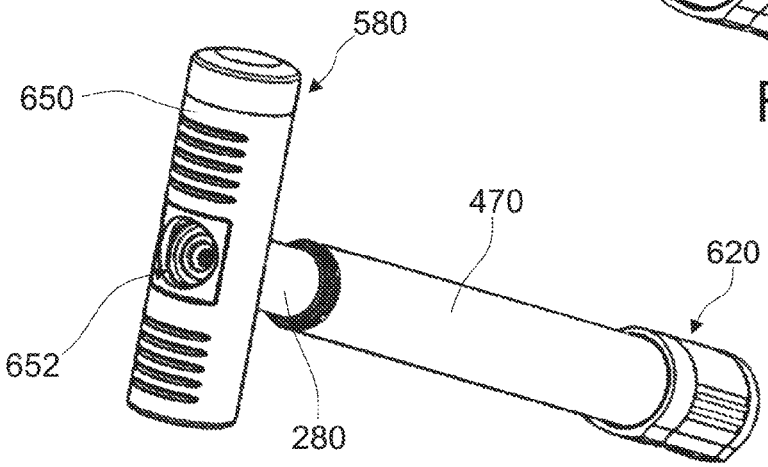
FIG. 25 is a perspective view of the pump in the configuration shown in FIG. 19, with the flexible hose assembly stored inside.
Figure 26:
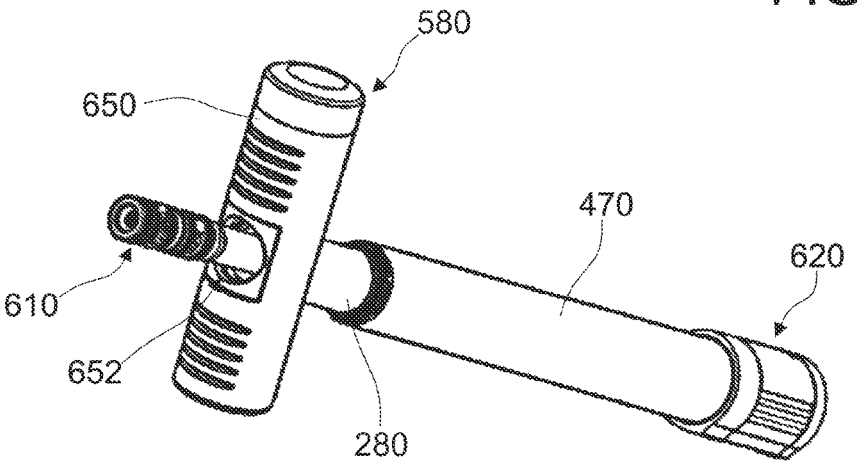
FIG. 26 is a perspective view of the pump of FIG. 18, with the handle pivoted into the open position and with the flexible hose assembly partially removed.
Figure 27:
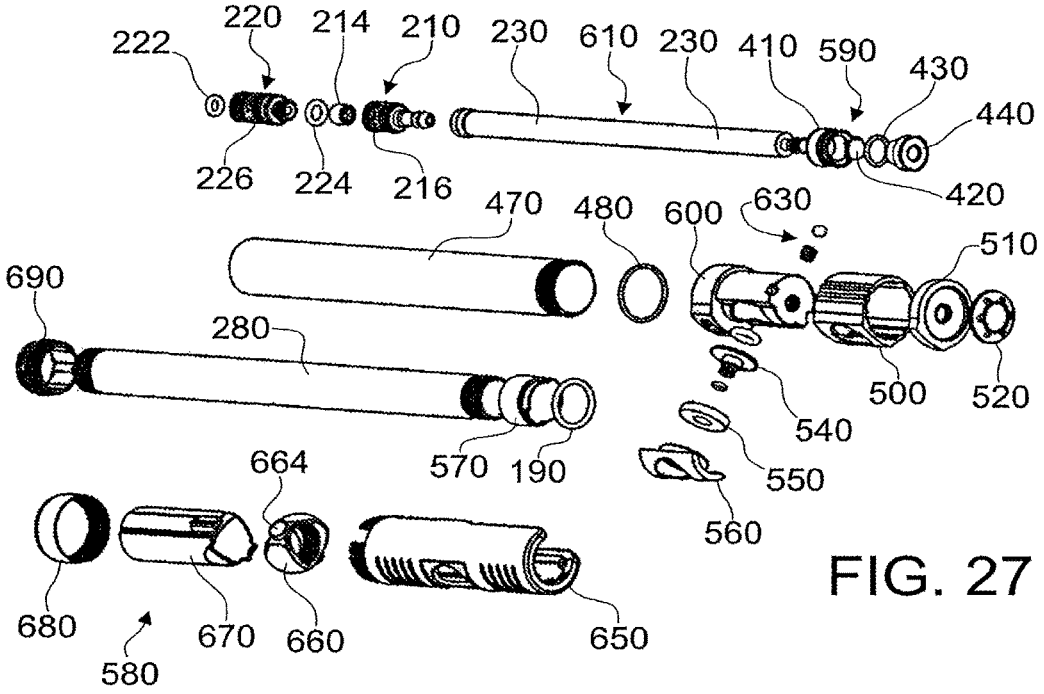
FIG. 27 is and exploded view of the pump of FIG. 18 according to an alternative embodiment of the invention.

When the handle 650 is in the storage position, it is held closed because the first lip 654 of handle 650 engages with the second lip 692 of the thread ring 690, therefore creating a snap fit between the two parts. When the handle 650 is turned in the open pumping position, the first opening 652 is aligned with the second opening 662, allowing free access to the cavity of the inner tube 280, where the flexible hose assembly 610 is stored when the pump 400 is not in use. In this configuration, the flexible hose assembly 610 can freely and easily slide out of the inner tube 280 (FIGS. 22 and 26). In this way, no rubber cap is necessary for securing the flexible hose assembly 610 inside of pump 400 during storage: the pump head assembly 620 is therefore simplified. In addition, the pumping action can be performed more effectively, since the handle 650 is arranged at about 90° relative to the inner tube 280, and it can be grasped more firmly.

Figure 32:
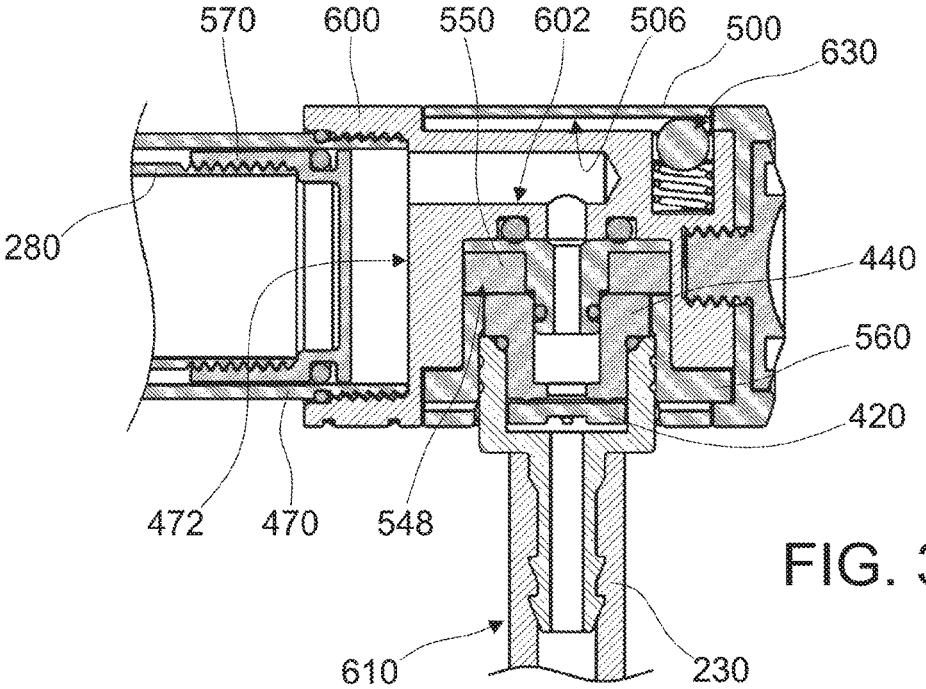
FIG. 32 is a close up sectional view of the pump shown in FIG. 31, with the flexible hose assembly completely installed into the head assembly.

The head assembly 620 comprises a housing 600, which is connected to one end of the outer tube 470 of the body assembly 402, with interposition of an O-ring 480. The housing 600 includes a through hole 602 which puts in communication the air chamber 472 with the air outlet opening 562, engageable by the flexible hose assembly 610 in pumping configuration (as shown in FIG. 32), as better disclosed hereafter. The axis of the opening 562 is arranged substantially at 90° in relation to the axis of the piston 570. This arrangement achieves a more comfortable performance of the pumping operation.

Figure 28:
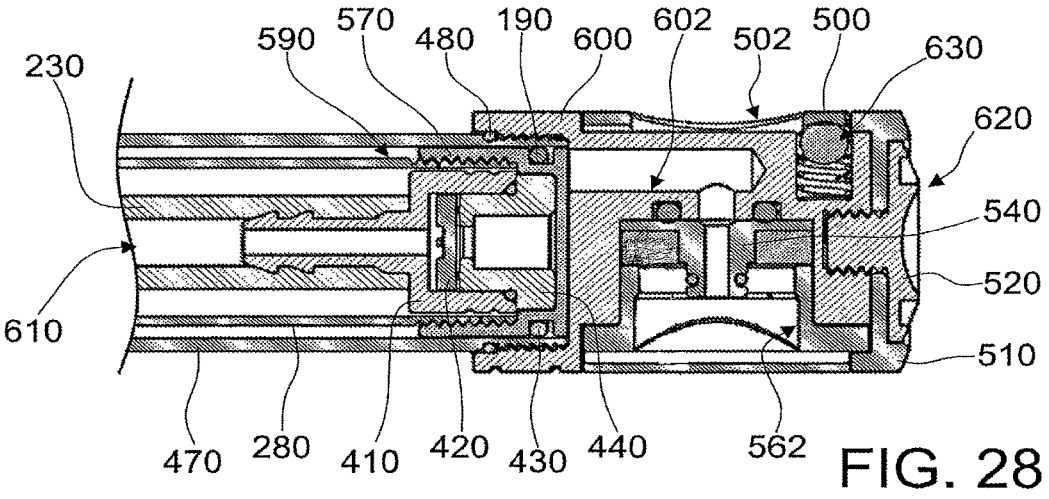
FIG. 28 is a close up sectional view of the head portion of the pump of FIG. 18 according to an alternative embodiment of the invention with the sleeve in a closed position.

According to one embodiment of the present invention, the head assembly 620 comprises a rotatable sleeve 500. The rotatable sleeve 500 is suitable to selectively open or close the opening 562 engageable by the flexible hose assembly 610, with respect to the configuration of the pump 400 (storage configuration or pumping configuration). For this purpose, the sleeve 500 includes a side opening 502. More in detail, the sleeve 500 is rotatable around the piston 570 axis. The sleeve 500 is rotatable between at least an open position of the opening 562 (FIGS. 29 and 30) and at least a closed position of the opening 562 (FIG. 28).

In the open position, the opening 562 of the housing 600 is aligned with the side opening 502 of the sleeve 500. In the closed position, the opening 562 of the housing 600 is occluded by the sleeve 500 itself.

According to the embodiment of the invention shown in FIGS. 27-30, the sleeve 500 is rotatable between a single open position of the opening 562 and a plurality of closed positions of the same opening 562. This allows quicker preparation of the pump 400 for performing the pumping, and quicker storing of the pump 400 itself when the pumping is performed: in fact, starting for example from the open position (FIG. 29), the user can get the opening 562 fully closed by simply rotating the sleeve 500 by an angle which can be widely less than 180°. The same applies when the user must start performing the pumping action, and he must therefore rotate the sleeve 500 from the closed position to the open position.

According to one embodiment of the invention, the head assembly 620 includes a locking element 630 of the sleeve 500. More in detail, the sleeve 500 is selectively held in the open position or in the closed position by a locking element 630. In the embodiment of the invention shown in FIGS. 27-30, the locking element 630 is associated with the housing 600; in other embodiments of the invention, the locking element 630 could be associated to the sleeve 500, instead of the housing 600, achieving an equivalent solution.

Figure 30:
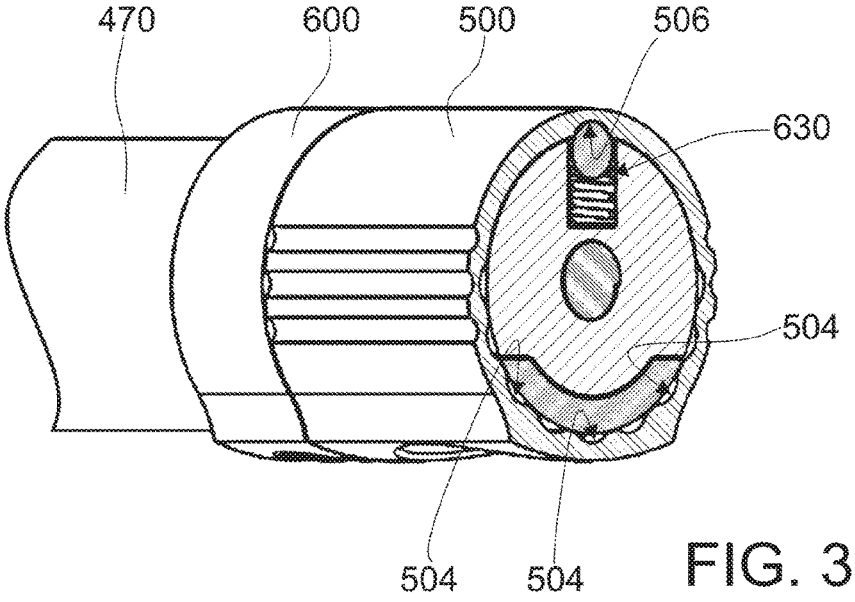
FIG. 30 is a close up perspective sectional view of the pump shown in FIG. 29.

The sleeve 500 comprises a first seat 506, in which the locking element 630 is engageable when the sleeve 500 is in the open configuration. Furthermore, the sleeve 500 includes at least a second seat 504, in which the locking element 630 is engageable when the sleeve 500 is in the closed configuration. More in detail, the sleeve 500 includes a plurality of second seats 504 in which the locking element 630 is selectively engageable when the sleeve 500 is in the closed configuration, for the reasons previously clarified. As shown in FIG. 30, the first seat 506 is diametrically opposed to one of the second seats 504. The remaining second seats 504 are symmetrically arranged with respect to said first seat 506. This means that the user can rotate the sleeve 500 to the open configuration indifferently in clockwise or counterclockwise direction in order to engage the locking element 630 in one of the second seats 504, by turning the sleeve 500 by an angle less than 180°.

Figure 29:
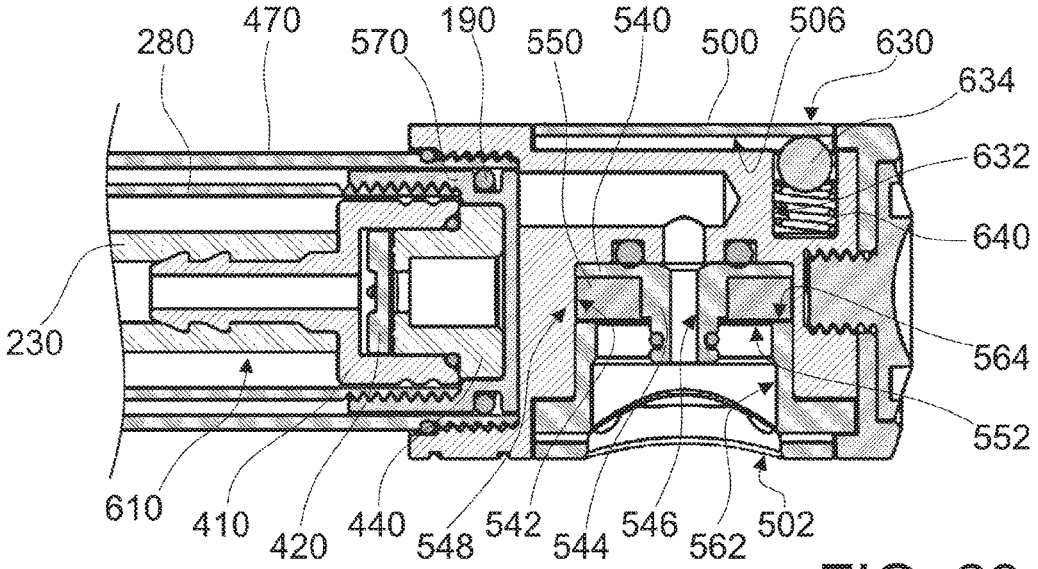
FIG. 29 is a close up sectional view of the head portion of the pump shown in FIG. 28, with the sleeve in the open position.

In the embodiment of the invention shown in FIGS. 27-30, the locking element 630 is spring loaded. The locking element 630 comprises a cylindrical seat 632 provided in the housing 600. A spring 640 is housed in the cylindrical seat 632, and a ball 634 is arranged on the spring 640. The ball 634 is therefore spring loaded inside the cylindrical seat 632. Correspondingly, the first seat 506 and the second seats 504 provided in the sleeve 500 are constituted by parallel channels, which develop along the axis of the piston 570. Twisting sleeve 500 with fingers allows sleeve 500 to "click" closed into any of the second seats 504 (FIG. 28), or "click" into the first seat 506 in an aligned and open position (FIGS. 29 and 30). A cap 510 and a respective screw 520 hold the sleeve 500 in engagement onto the housing 600.

A fitting 540 is engaged inside a side cavity 542 of the housing 600; an O-ring 530 is interposed between the fitting 540 and the bottom of the side cavity 542. The fitting 540 includes an axial protrusion 544, and an axial air passage 546.

According to one embodiment of the invention, the pump 400 includes a magnetic connection means 548 for connecting the flexible hose assembly 610 to the air outlet opening 562 of the head assembly 620 in a removable manner. The magnetic connection means 548 includes a first magnet 550. The first magnet 550 is housed in the head assembly 620. The first magnet 550 is ring shaped, or substantially ring shaped. The first magnet 550 is press fit and/or bonded to the fitting 540, and it faces the opening 562. Magnet 550 is also held into position by spacer 560.

In detail, the first magnet 550 is press fit and/or bonded to the axial protrusion 544 of the fitting 540. A spacer 560 is housed inside the side cavity 542 of the housing 600; the spacer 560 is held in position by the cap 510. The face 564 of the spacer 560 contacts the peripheral portion of the face 552 of the first magnet 550. The spacer 560 defines the above cited opening 562, in which the flexible hose assembly 610 can be engaged.

The flexible hose assembly 610 includes a flexible hose 230. The flexible hose assembly 610 includes a shrader valve adapter assembly 210, connected to an end of the flexible hose 230. The flexible hose assembly 610 further includes a presta valve adapter assembly 220, which is screwed to the shrader valve adapter assembly 210.

The flexible hose assembly 610 further includes a fitting assembly 590, which is connected to the other end of the flexible hose 230. According to one embodiment of the invention, the fitting assembly 590 includes a connector 410 (directly connected to the flexible hose 230) and a fitting 440 engaged inside the connector 410, with interposition of an O-ring 430. The fitting 440 is made from a magnetically attracted metal (for example steel). Between the connector 410 and the fitting 440 a one way valve 420 is arranged. The one way valve 420 is disc shaped, for example made of rubber. This means that the flexible hose assembly 610 could be installed onto the tire valve even before being magnetically connected to the body assembly 402, without any air loss. Furthermore, the flexible hose assembly 610 would not leak air if the magnetic connection to the pump body assembly 402 was accidentally dislodged during vigorous pumping. The flexible hose assembly 610 could be used also with the pump 10 according to the embodiment previously described: in that case, the one way valve 140 would no longer be necessary.

During pumping, the piston 570 of the handle assembly 580 pushes air through the hole 602 of housing 600; air turns a right angle and flow through fitting 540 and into hose assembly 610, and then through the tire valve into the tire. More specifically, air flows through fitting 440, around valve 420, through connector 410 and through the rest of the hose assembly 610.

Figure 31:
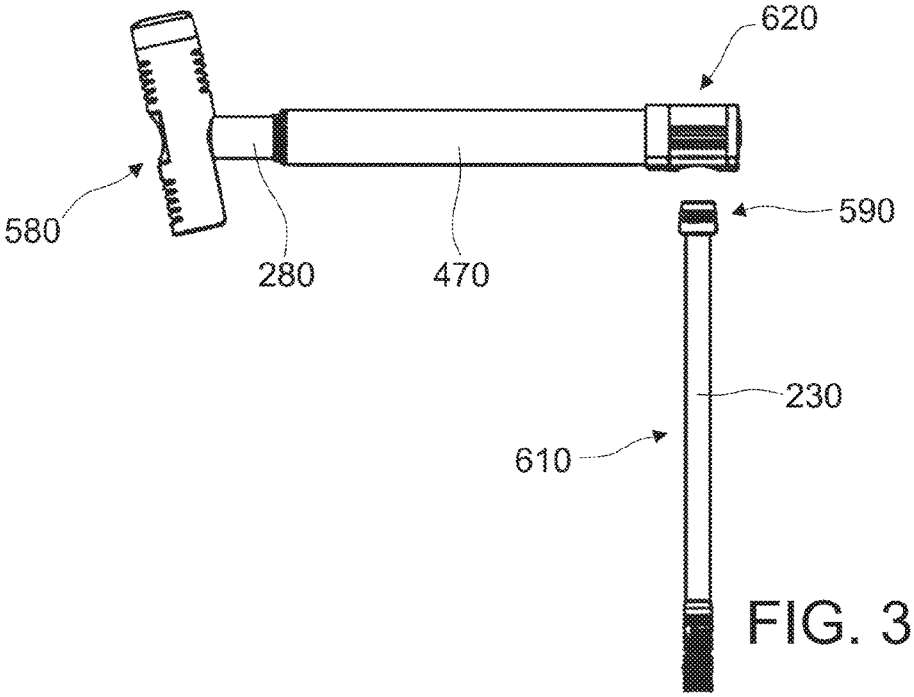
FIG. 31 is a side view of the pump of FIG. 18 according to an alternative embodiment with the flexible hose assembly almost installed into the head assembly.

FIG. 31 shows the flexible hose assembly 610 almost installed, with its fitting assembly 590 almost inserted into the head assembly 620. The fitting 440 is magnetically attracted to the first magnet 550. As the fitting assembly 590 is moved closer to the opening 562 of the spacer 560, the fitting 440 magnetically connects to the first magnet 550, and the O-ring 130 of the fitting 540 seals against the inner surface 444 of the cap 440, in order to allow pressurized airflow through the latter.

The magnetic attraction that holds fitting 440 to the first magnet 550 is strong enough to overcome air pressure during pumping, yet weak enough to be easily removed when finished pumping. For example, a neodymium magnet as shown in pump 400 has an outer diameter of 0.625 inch, an inner diameter of 0.25 inch, and a thickness of 0.125 inch. The sealed connection has a diameter of 0.200 inches, making for a surface area of 0.0314 square inches. This magnet, made form NdFeB, Grade N42, has a pull strength of 8.02 pounds, which is enough to with withstand 255 psi before releasing (P=F/A, or P=8.02/0.0314). Hand pumps are rarely used to pressurize a tire beyond 120 psi, so clearly this magnetic connection is strong enough.

According to a further embodiment of the invention, the pump 10, 400 could be a floor pump, rather than a hand pump. All the features disclosed regarding the previous embodiments of the invention could be provided also in a floor pump, without limitations: the only difference is that the body assembly 12, 402 of the pump 10, 400, in this case, is suitable to rest on the ground in a standing position (for example, it includes a pedestal).

In the embodiment disclosed hereafter individual characteristics, given in connection with such specific embodiment, may actually be interchanged with other different characteristics that exist in other embodiments. For example, the folding handle assembly 580 disclosed in pump 400 could work with pump 10; the handle assembly 70 of pump 10 could work with pump 400. Holding the handle assembly 70 magnetically closed like in pump 10 could work on handle assembly 580 of pump 400. The one way valve according to pump 400 could work with pump 10.

The present invention has been described according to various embodiments, but equivalent variants can be devised without departing from the scope of protection offered by the following claims.

What is claimed is:

1. A bicycle pump, comprising:

a pump body assembly including an outer tube defining an air chamber, and a head assembly with an air outlet opening;

a handle assembly, slidably associated with the pump body assembly, and including an inner tube and a piston slidable inside the outer tube;

a flexible hose assembly suitable to be stored inside the inner tube when the pump is not in use, and suitable to be connected to the air outlet opening during pumping, wherein the flexible hose assembly includes a flexible hose;

a first ring-shaped magnet housed in the head assembly and a corresponding metallic fitting connected to a first end of the flexible hose, for connecting the flexible hose assembly to the air outlet opening of the head assembly in a removable manner; and a second ring-shaped magnet, housed in the head assembly and facing the air chamber, suitable to magnetically attract the metallic fitting through a wall of the piston when the flexible hose assembly is stored inside the inner tube of the handle assembly.

2. The bicycle pump of claim 1, wherein the first ring-shaped magnet is press fit and/or bonded to an axial protrusion of a fitting included in the head assembly, the axial protrusion being suitable to achieve an air tight and a removable connection to the flexible hose assembly.

3. The bicycle pump of claim 1, wherein the second ring-shaped magnet is press fit and/or bonded to a tubular extension protruding from a housing lodged inside the head assembly, the tubular extension facing the air chamber.

4. The bicycle pump of claim 1, wherein the head assembly includes a fitting configured to connect to the flexible hose assembly and including an air channel, a housing delimiting the air chamber and including an air passage which puts the air chamber in communication with the air outlet opening through the air channel, and a one way valve disc interposed between the fitting and the housing.

5. The bicycle pump of claim 4, wherein the housing is connected to an end of the outer tube and comprises a tubular extension protruding from the housing.

6. The bicycle pump of claim 4, wherein the head assembly further comprises a thread ring connected to the housing and an end cap.

7. The bicycle pump of claim 6, wherein the end cap presses inside of the thread ring to keep the bicycle pump clean when stored.

8. The bicycle pump of claim 1, including an end cap allowing access to an inner cavity of the inner tube.

9. The bicycle pump of claim 1, including an end cap suitable to selectively open and close the air outlet opening of the head assembly.

10. The bicycle pump of claim 1, wherein the body assembly includes a pedestal for resting on the floor.

11. The bicycle pump of claim 1, wherein the flexible hose assembly comprises a shrader valve adapter assembly connected to an end of the flexible hose.

12. The bicycle pump of claim 11, wherein the flexible hose assembly further comprises a presta valve adapter assembly that is screwed to the shrader valve adapter assembly.

13. A bicycle pump, comprising:

a body assembly including an outer tube defining an air chamber, and a head assembly with an air outlet opening and a first end cap suitable to selectively open and close the air outlet opening;

a handle assembly, slidably associated with the body assembly, and including an inner tube, a piston, and a second end cap allowing access to an inner cavity of the inner tube;

a flexible hose assembly suitable to be stored inside the inner tube when the pump is not in use, and suitable to be connected to the air outlet opening during pumping, wherein the flexible hose assembly includes a flexible hose;

a first ring-shaped magnet housed in the head assembly and a corresponding metallic fitting connected to a first end of the flexible hose, for connecting the flexible hose assembly to the air outlet opening of the head assembly in a removable manner; and a second ring-shaped magnet, housed in the head assembly and facing the air chamber, suitable to magnetically attract the metallic fitting through a wall of the piston when the flexible hose assembly is stored inside the inner tube of the handle assembly.

14. A bicycle pump, comprising:

a pump body assembly including an outer tube defining an air chamber, and a head assembly with an air outlet opening;

a handle assembly, slidably associated with the pump body assembly, and including an inner tube and a piston slidable inside the outer tube, wherein the head assembly includes magnetic retention means of the handle assembly inside the pump body assembly when the pump is not in use;

a flexible hose assembly suitable to be stored inside the inner tube when the pump is not in use, and suitable to be connected to the air outlet opening during pumping; and a magnetic connection means for connecting the flexible hose assembly to the air outlet opening of the head assembly in a removable manner.

* * * * *